United States Patent [19]

Herrmann

[11] 4,416,410

[45] Nov. 22, 1983

[54] SANDPAPER ROLL DISPENSER

[76] Inventor: Ronald S. Herrmann, 3353 Polk St., N.E., Minneapolis, Minn. 55418

[21] Appl. No.: 384,474

[22] Filed: Jun. 3, 1982

[51] Int. Cl.[3] ..... B65D 5/08; B65D 5/54

[52] U.S. Cl. ..... 229/38; 206/44 R; 206/409; 206/620; 225/49; 229/175; 229/39 R; 229/44 R

[58] Field of Search ..... 225/41, 49; 221/305; 206/44 R, 409, 620; 229/38, 39 R, 44 R, 7 R, 17 R, 175

[56] References Cited

U.S. PATENT DOCUMENTS

| | | | |
|---|---|---|---|
| 1,541,143 | 6/1925 | Hoile | 229/17 R |
| 1,800,550 | 4/1931 | Mahoney, Jr. et al. | 206/620 X |
| 2,115,673 | 4/1938 | Stompe | 229/175 X |
| 2,294,965 | 9/1942 | Davidson | 206/44 S |
| 2,968,431 | 1/1961 | Pellaton | 229/17 R |
| 2,991,958 | 7/1961 | Eifred | 206/409 X |
| 3,722,767 | 3/1973 | Struble | 225/49 |
| 3,735,914 | 5/1973 | Collura et al. | 229/17 R |
| 3,750,930 | 8/1973 | Roth | 229/17 B |
| 3,944,128 | 3/1976 | Hogan | 229/17 B |
| 3,961,706 | 7/1976 | Roccaforte et al. | 206/44 R |
| 3,993,241 | 11/1976 | Downing | 229/17 B X |
| 4,062,486 | 12/1977 | Goodrich | 229/17 R X |
| 4,064,988 | 12/1977 | Mazie et al. | 206/44 R |
| 4,316,563 | 2/1982 | Turner et al. | 225/49 X |

FOREIGN PATENT DOCUMENTS

| | | | |
|---|---|---|---|
| 916627 | 1/1963 | United Kingdom | 206/44 R |

*Primary Examiner*—William Price
*Assistant Examiner*—Gary E. Elkins
*Attorney, Agent, or Firm*—Laubscher, Philpitt & Laubscher

[57] ABSTRACT

A paperboard blank for forming a dispenser for rolls of sandpaper and the like is disclosed. The blank includes rear, first side, front and second side walls defined by spaced vertical fold lines and rear, first side, front, and second side wall bottom flaps connected with the lower edges of the rear, first side, front, and second side walls by a horizontal fold line, respectively. The bottom flaps are folded about the horizontal fold line and the walls are folded about the vertical fold lines to form the dispenser. The blank is characterized by top flaps connected by horizontal fold lines with the upper edges of the rear, first side, and second side walls and which are folded in different manners depending upon whether the dispenser is to be formed into its closed shipping condition or into its open dispensing condition.

10 Claims, 18 Drawing Figures

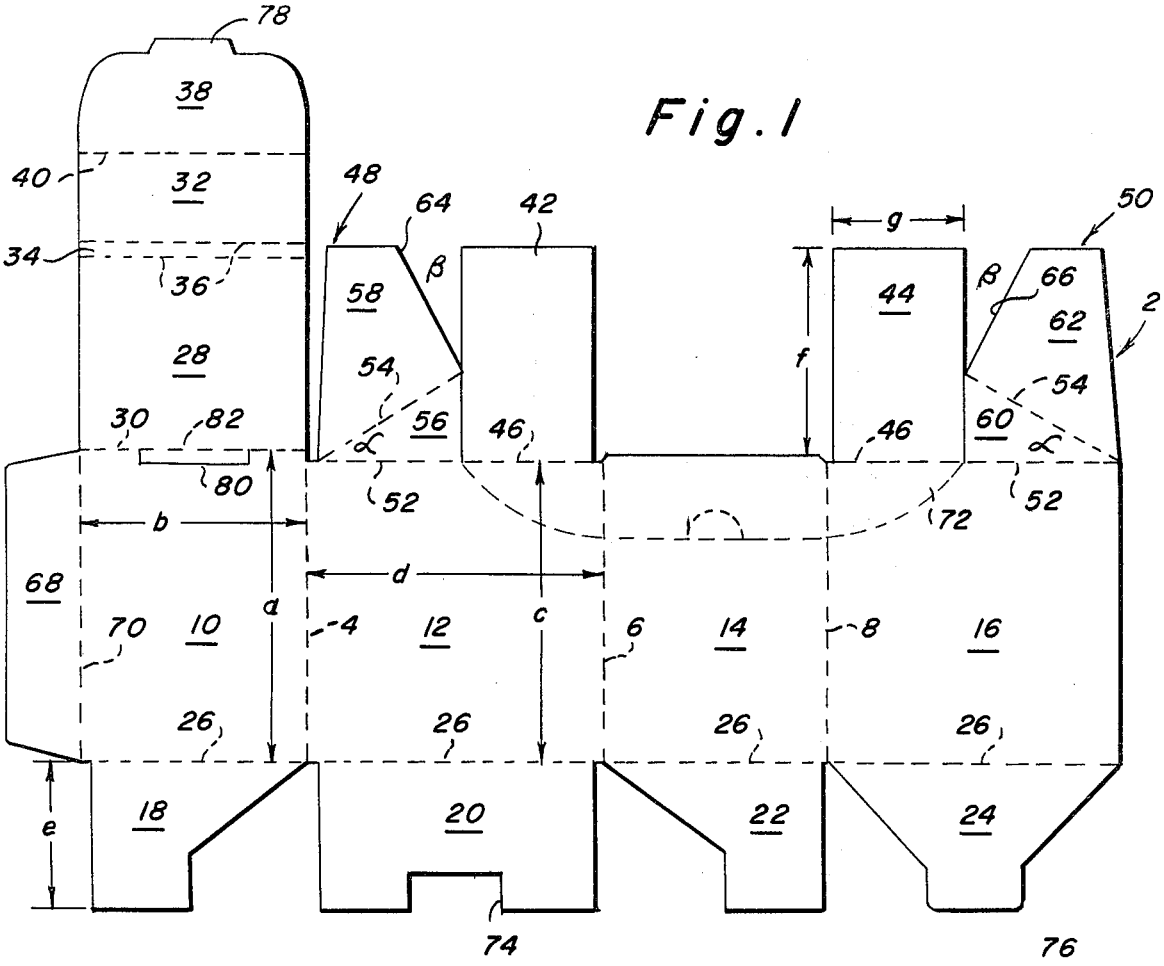
Fig. 1
Fig. 2
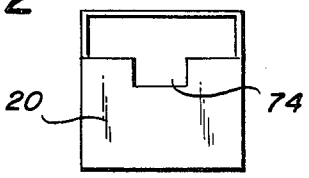
Fig. 3
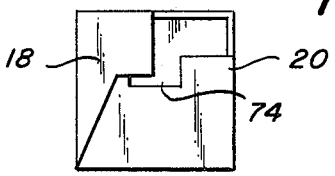
Fig. 4
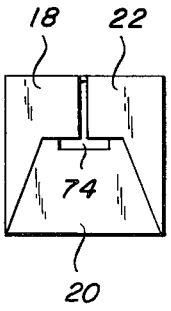
Fig. 5
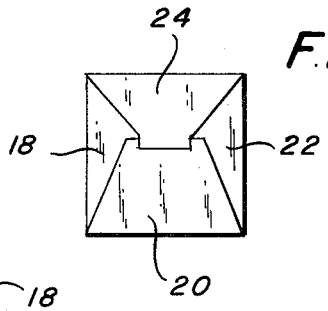
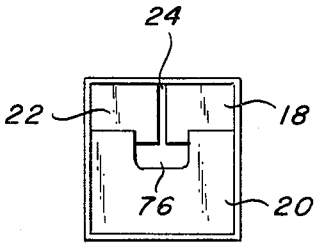
Fig. 6

Fig. 11
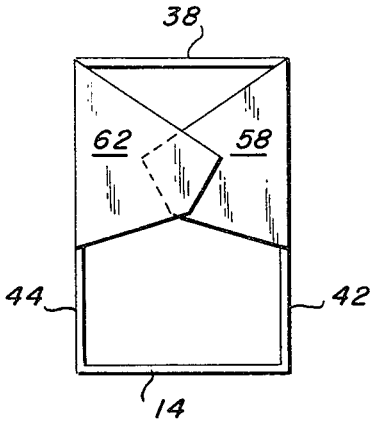
Fig. 12
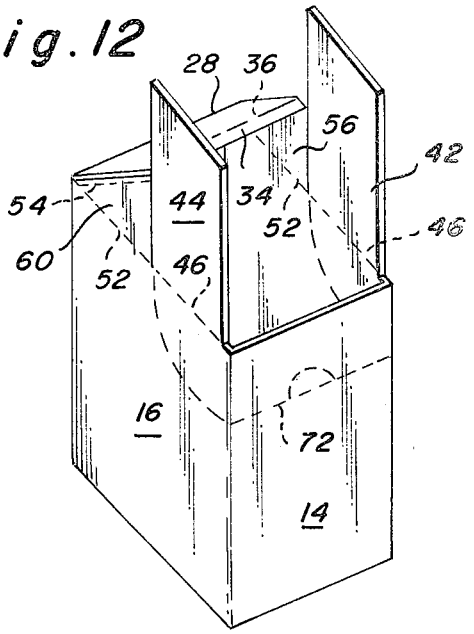
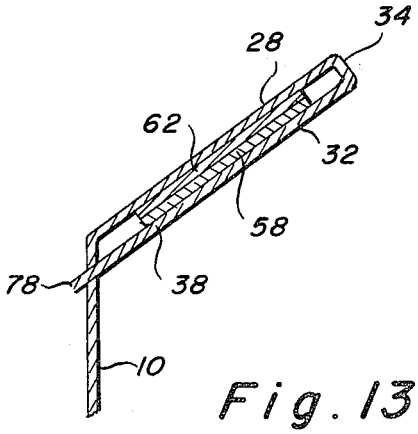
Fig. 13
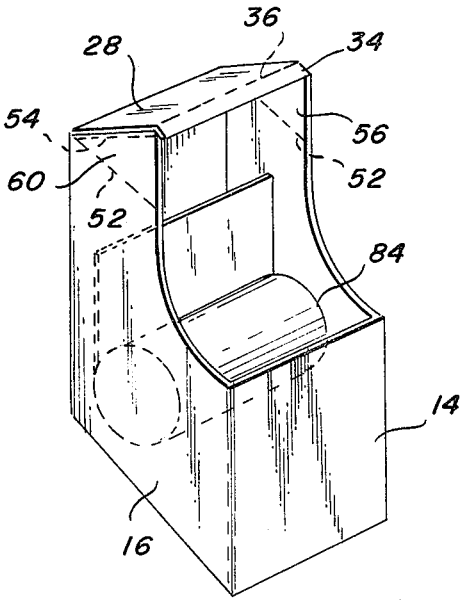
Fig. 14

Fig. 15
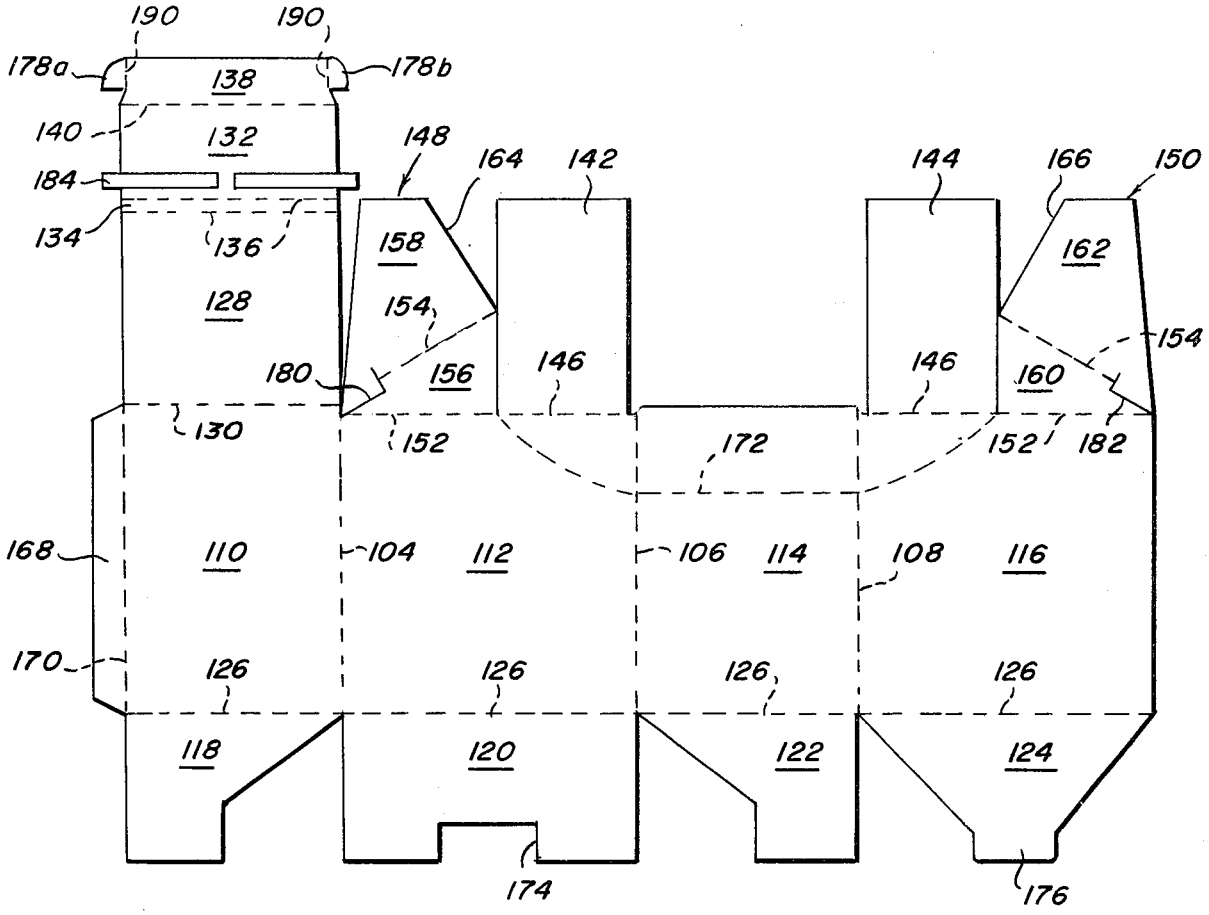
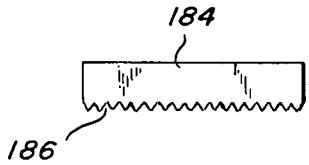
Fig. 16
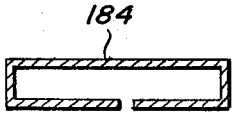
Fig. 17
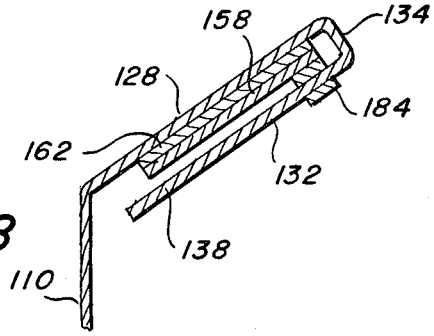
Fig. 18

SANDPAPER ROLL DISPENSER

BACKGROUND OF THE INVENTION

The present invention relates to a paperboard blank for forming a dispenser for rolls of sandpaper, tape, paper, and the like. The blank is foldable into different configurations whereby the roll product may be shipped in and dispensed from the same container. When in the dispensing condition, the dispenser also displays the contents thereof. Since the same container is used for shipping, displaying, and dispensing the product, a savings in cost is realized by the consumer.

BRIEF DESCRIPTION OF THE PRIOR ART

Numerous shipping and display containers are disclosed in the patented prior art as evidenced, for example, by the patents to Davidson U.S. Pat. No. 2,294,965 and Roccaforte et al. U.S. Pat. No. 3,961,706 which disclose combined packing and display cartons formed from a single blank which contains perforations which define removable portions for display. Similarly, the patented prior art discloses various shipping and dispensing containers as evidenced by the patents to Pellaton U.S. Pat. No. 2,968,431, Ruth U.S. Pat. No. 3,750,930, and Hogan U.S. Pat. No. 3,944,128. The Pellaton patent discloses a carton for dispensing flat paper products and the Ruth patent discloses a carton having a tear-away zone for removal of selected packages. The Hogan patent discloses a dispensing container having a front wall portion adapted to tilt outwardly to provide a dispensing trough.

While the prior shipping and dispensing or display cartons normally operate quite satisfactorily, none of them are suitable for shipping and dispensing a product in roll form such as sandpaper, tape, or the like.

The present invention was developed in order to overcome the above and other drawbacks of the dispensers of the prior art by providing a roll dispenser formed from a unitary paperboard blank which is foldable to both closed shipping and open dispensing conditions.

SUMMARY OF THE INVENTION

Accordingly, it is a primary object of the invention to provide a paperboard blank for forming a dispenser for rolls of sandpaper or the like. The blank has a generally rectangular configuration and contains first, second, and third spaced vertical fold lines defining rear, first side, front, and second side walls. Bottom flaps are connected by horizontal fourth fold lines with the lower edges of the rear, first side, front, and second side walls, respectively. A rectangular rear wall top flap is connected at its lower edge by a fifth fold line with the upper edge of the rear wall, and a rectangular rear wall top locking member is connected with the upper edge of the rear wall top flap by a rear wall top bridge flap defined by a pair of spaced horitzontal sixth fold lines. A rear wall top locking flap is connected by a horizontal seventh fold line with the upper edge of the rear wall top locking member. First and second rectangular side wall top flaps are connected by horizontal eighth fold lines with the upper edges of the first and second side walls, respectively. Each of the first and second side wall top flaps has a width that is less than the associated side wall, and the side wall top flaps are arranged adjacent the fold lines defining the front wall, respectively. First and second side wall top members are connected by horizontal ninth fold lines with the upper edges of the first and second side walls adjacent the vertical edges of the side walls remote from said front wall, respectively. Each of the side wall top members contains angularly arranged tenth fold lines each extending from the corresponding vertical edge of said front wall at an acute angle relative to the top edge of the associated side wall, thereby to define in each side wall top member a triangular first portion connected with the associated side wall and a second portion. The generally vertical edge of the second portion of each side wall top member adjacent the associated side wall top flap is relieved and angularly arranged at an acute angle relative to the adjacent vertical edge of the associated side wall top flap. The blank is folded about the first, second, and third fold lines to form a hollow tube having a rectangular cross-sectional configuration, and the first side, rear, front, and second side wall bottom flaps are folded upwardly about the fourth fold lines to positions normal to their associated walls to form the dispenser for the rolls of sandpaper. In order to form the dispenser in its closed shipping condition, the first and second side wall top flaps and the first and second side wall top members are folded downwardly about the eighth and ninth fold lines, respectively, to positions normal to their associated side walls. The rear wall top flap is then folded downwardly about the fifth fold line to a position normal to the rear wall and the rear wall top locking flap is folded downwardly about the seventh fold line to a position normal to the folded rear wall top flap to completely close the dispenser. In order to form the dispenser into its open dispensing condition, the second portions of each of the first and second side wall top members are folded downwardly about the tenth fold lines, respectively, and the rear wall top flap is folded downwardly to a position in contiquous relation with the second portions of the first and second side wall top members. The rear wall top locking member is then folded downwardly about the pair of sixth fold lines to a position parallel to the rear wall top flap, with the rear wall top bridge flap defining a space between the rear wall top flap within which the second portions of the first and second side wall top members are arranged.

According to a further object of the invention, the rear wall top locking flap includes a device for locking the rear wall top flap in its folded position, thereby to lock the dispenser in its open dispensing condition.

It is another object of the invention to provide a zipper cut in the first side, front, and second side walls which extends continuously between the edges of the first and second side wall top flaps remote from the vertical edges of the front wall, respectively. Thus when the dispenser blank is torn along the zipper cut, the first and second side wall top flaps, and portions of the first side, front, and second side walls are removed to provide greater access to the interior of the dispenser when it is in the dispensing condition.

According to another object of the invention, a serration device is connected with the rear wall top locking member so that a length of sandpaper or the like may be torn from the roll within the dispenser.

BRIEF DESCRIPTION OF THE FIGURES

These and other objects of the invention will become apparent from a study of the following specification when viewed in the light of the accompanying drawing, in which:

FIG. 1 is a plan view of the generally rectangular blank for forming the dispenser;

FIGS. 2–5 are bottom views of the dispenser showing the folding steps for forming the bottom of the dispenser;

FIG. 6 is a top view of the folded bottom of the dispenser;

FIGS. 11 and 12 are top and perspective views, respectively, illustrating the folding of the top of the dispenser into its open dispensing condition;

FIG. 13 is a side sectional view of the top of the dispenser in its open dispensing condition;

FIG. 14 is a perspective view of the dispenser in its open dispensing condition with a portion thereof torn away along a zipper cut;

FIG. 15 is a plan view of an alternate embodiment of a generally rectangular blank for forming the dispenser;

FIGS. 16 and 17 are top and front sectional views, respectively, of a serration device; and FIG. 18 is a side sectional view of the top of the dispenser folded from the blank of FIG. 15 in its open dispensing condition.

DETAILED DESCRIPTION

Figure 7:
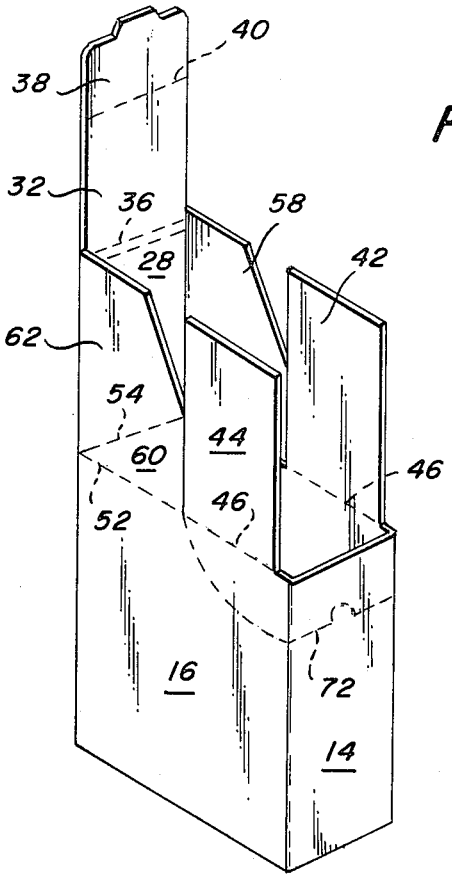
FIG. 7 is a perspective view of the partially folded dispenser blank which forms a carton for a roll product.

Referring first more particularly to FIG. 1, a generally rectangular unitary blank 2 for forming a dispenser for rolls of sandpaper, tape, paper and the like is shown. The blank is formed of an inexpensive paperboard material such as corrugated cardboard which has sufficient strength and durability for shipping and dispensing the product. The blank contains first 4, second 6, and third 8 spaced vertical fold lines which define rear 10, first side 12, front 14, and second side 16 walls, respectively. The lengths a and widths b of the rear and front walls are equal, and the lengths c and widths d of the first and second side walls are equal.

Rear 18, first side 20, front 22, and second side 24 wall bottom flaps are connected by horizontal fourth fold lines 26 with the lower edges of the rear, first side, front, and second side walls, respectively, the lengths e of the bottom flaps being less than the width b of the rear wall.

A rectangular rear wall top flap 28 is connected at its lower edge by a horizontal fifth fold line 30 with the upper edge of the rear wall. A rectangular rear wall top locking member 32 is connected at its lower edge with the upper edge of the rear wall top flap by a rear wall top bridge flap 34 defined by a pair of spaced horizontal sixth fold lines 36.

A rear wall top locking flap 38 is connected by a horizontal seventh fold line 40 with the upper edge of the rear wall top locking member. The distance between the fifth fold line 30 and the seventh fold line 40 is slightly less than the width d of the first and second side walls as will be set forth in greater detail below.

First 42 and second 44 rectangular side wall top flaps are connected by horizontal eighth fold lines 46 with the upper edges of the first and second side walls. The length f of the side wall top flaps is slightly less than the width b of the rear wall. Each of the side wall top flaps has a width g which is less than the width d of the associated side wall. As shown in FIG. 1, the side wall top flaps are arranged adjacent the second 6 and third 8 fold lines which define the front wall 14 and spaced from the vertical edges of the side walls remote from the front wall.

First 48 and second 50 side wall top members are connected by horizontal ninth fold lines 52 with the upper edges of the first and second side walls adjacent the vertical edges of the side walls remote from the front wall, respectively. Each of the side wall top members contains an angularly arranged tenth fold line 54 extending from the corresponding vertical edge of the side walls remote from the front wall at an acute angle $\alpha$ relative to the top edge of the associated side wall. The tenth fold lines thus define a triangular first portion 56 and a second portion 58 in the first side wall top member, the lower edge of the first portion 56 being connected with the first side wall 12, and a triangular first portion 60 and a second portion 62 in the second side wall top member, the lower edge of the first portion 60 being connected with the second side wall 16. The generally vertical edges 64, 66 of the second portions of the first and second side wall top members are relieved and angularly arranged at an acute angle $\beta$ relative to the adjacent vertical edge of the associated side wall top flap.

A locking wall 68 is connected with the rear wall by a vertical eleventh fold line 70 spaced from the first fold line.

A zipper cut 72 is provided in the first side, front, and second side walls of the blank and extends continuously between the edges of the first and second side wall top flaps remote from the vertical edges of the front wall, respectively. The purpose of the zipper cut will be discussed more fully below.

In order to form a container for holding rolls of sandpaper or the like, the blank is initially folded about the first, second, third, and eleventh fold lines to form a hollow tube having a generally rectangular configuration. The locking wall 68 is arranged in contiguous relation with the inner surface of the second side wall 16 and secured thereto by any suitable means such as a layer of adhesive. It is apparent to those skilled in the art that any suitable device may be provided in place of the locking wall to secure the blank in its folded tubular condition. One such alternative device is a layer of adhesive tape to secure the adjacent edges of the rear and second side walls together.

Referring now to the sequence of FIGS. 2–5 the first side wall bottom flap 20 is folded upwardly about the fourth fold line to a position normal to the first side wall, following which the rear and front wall bottom flaps 18, 20 are folded upwardly about the fourth fold line to positions normal to their associated walls. Finally, the second side wall bottom flap 24 is folded upwardly about the fourth fold line to a position normal to the second side wall to form the bottom of the container, the bottom flaps being locked in their folded conditions. To this end, the first side wall bottom flap 20 contains a cut-out portion 74 in the lower edge thereof and the second side wall bottom flap 24 contains a tab portion 76 in the lower edge thereof corresponding to the cut-out portion. When the bottom flaps are folded as set forth above, the tab portion of the second side wall bottom flap is inserted into the cut-out portion of the first side wall bottom flap as shown in FIGS. 5 and 6.

With the bottom flaps folded and locked and the rear, front, and side walls folded and secured, the blank is formed into the container configuration shown in FIG.

A serration device may also be provided with the blank of FIG. 1.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. A paperboard blank for forming a dispenser for rolls of sandpaper or the like, comprising (a) a rectangular blank (2), containing first (4), second (6), and third (8) spaced vertical fold lines for defining rear (10), first side (12), front (14), and second side (16) walls, respectively;

(b) rear (18), first side (20), front (22), and second side (24) wall bottom flaps connected by horizontal fourth fold lines (26) with the lower edges of said rear, first side, front and second side walls, respectively;

(c) a rectangular rear wall top flap (28) connected at its lower edge by a horizontal fifth fold line (30) with the upper edge of said rear wall;

(d) a rectangular rear wall top locking member (32);

(e) horizontal sixth fold means (36) connecting said rear wall top locking member with the upper edge of said rear wall top flap;

(f) a rear wall top locking flap (38) connected by a horizontal seventh fold line (40) with the upper edge of said rear wall top locking member;

(g) first (42) and second (44) rectangular side wall top flaps connected by horizontal eighth fold lines (46) with the upper edges of said first and second side walls, respectively, each of said first and second side wall top flaps having a width (g) that is less than the associated side wall, said side wall top flaps being adjacent the fold lines defining said front wall, respectively, whereby said first and second side wall top flaps are spaced from the vertical edges of said side walls remote from said front wall, respectively; and (h) first (48) and second (50) side wall top members connected by horizontal ninth fold lines (52) with the upper edges of said first and second side walls adjacent the vertical edges of said side walls remote from said front wall, respectively, each of said side wall top members containing angularly arranged tenth fold lines (54) each extending from the corresponding vertical edge of said side walls remote from said front wall at an acute angle ($\alpha$) relative to the top edge of the associated side wall, thereby to define in each side wall top member a triangular first portion (56, 60) connected with the associated side wall and a second portion (58,62), the generally, vertical edge of said second portion adjacent the associated side wall top flap being relieved and angularly arranged at an acute angle ($\beta$) relative to the adjacent vertical edge of the associated side wall top flap, whereby when said rear, first side, front, and second side walls are folded inwardly about said first, second, and third fold lines to form a hollow tube having a rectangular cross-sectional configuration, when said first side, rear, front, and second side wall bottom flaps are folded upwardly about said fourth fold lines to positions normal to their associated walls, when said first and second side wall top flaps are folded downwardly about said eighth fold lines to positions normal to their associated walls, when said first and second side wall top members are folded downwardly about said ninth fold lines to positions normal to their associated walls, when said rear wall top flap is folded downwardly about said fifth fold line to a position normal to said rear wall, and when said rear wall top locking flap is folded downwardly about said seventh fold line to a position normal to said rear wall top flap, the dispenser is in a closed shipping condition; and when said rear, first side, front, and second side walls are folded inwardly about said first, second and third fold lines to form a hollow tube having a rectangular cross-sectional configuration, when said first side, rear, front, and second side wall bottom flaps are folded upwardly about said fourth fold lines to positions normal to their associated walls, when said second portions of each of said first and second side wall top members are folded downwardly about said tenth fold lines, respectively, when said rear wall top flap is folded downwardly about said fifth fold line to a position in contiguous relation with said first and second side wall top member second portions, and when said rear wall top locking member is folded downwardly about said sixth fold means to a position parallel to and spaced from said rear wall top flap with said first and second side wall top member second portions arranged therebetween, the dispenser is in its dispensing condition.

2. A blank as defined in claim 1, wherein said sixth fold means comprises a pair of vertically spaced fold lines which define a rear wall top bridge flap connecting said rear wall top locking member with said rear wall top flap.

3. A blank as defined in claim 2, wherein the height (a) and width (b) of said rear and front walls, respectively, are equal, and further wherein the height (c) and width (d) of said first and second side walls, respectively, are equal.

4. A blank as defined in claim 3, wherein the distance (e) between said fifth and seventh fold lines is slightly less than the width (d)of said first and second side wall, respectively.

5. A blank as defined in claim 4, wherein said rear wall top locking the flap includes means for locking said rear wall top flap in its folded position, thereby to lock said dispenser in its open dispensing condition.

6. Apparatus as defined in claim 5, wherein said first side, front and second side walls contain a zipper-cut extending continuously between the edges of said first and second side wall top flaps remote from the vertical edges of said front wall, respectively, whereby when said blank is torn along said zipper cut, said first and second side wall top flaps, and portions of said first side, front, and second side walls are removed to provide greater access to the interior of the dispenser when it is in the dispensing condition.

7. A blank as defined in claim 4, and further comprising serration means connected with said rear wall top locking member.

8. A blank as defined in claim 3, wherein said second side wall bottom flap includes a tab in the lower edge thereof, and further wherein said first side wall bottom flap contains a cutout portion in the lower edge thereof corresponding to and adapted to receive said tab when said bottom flaps are folded about said fourth fold lines.

7. In this configuration, the dispenser is ready to receive the rolls of sandpaper or the like.

Figure 8:
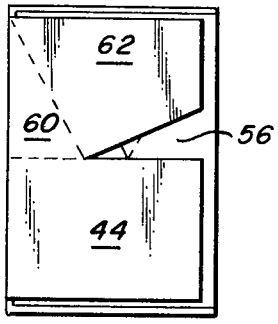
FIGS. 8 and 9 are top views of the dispenser illustrating the folding of the top of the dispenser into its closed shipping condition.
Figure 9:
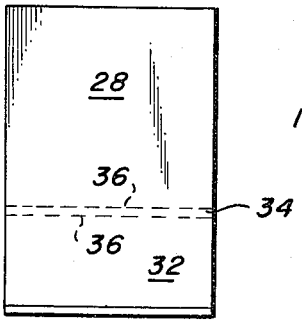

From the configuration shown in FIG. 7, the dispenser containing the rolls of sandpaper is readily folded to its closed shipping condition. The first and second side wall top flaps 42, 44 are folded downwardly about the eight fold lines 46 to positions normal to their associated walls and the first and second side wall top members 48, 50 are folded downwardly about the ninth fold lines 52 to positions normal to their associated walls as shown in FIG. 8. Next, the rear wall top flap 28 is folded downwardly about the fifth fold line 30 to a position normal to the rear wall as shown in FIG. 9. Finally, the rear wall top locking flap 38 is folded downwardly about the seventh fold line 40 to a position normal to the rear wall top flap. Because the distance between the fifth 30 and seventh 40 fold lines is slightly less than the width d of the first side wall 12, the rear wall top locking flap 38 is arranged in contiquous relation with the inner surface of the front wall 14 as shown more particularly in the cross-sectional view of FIG. 10 of the top of the dispenser in its closed shipping condition.

Figure 10:
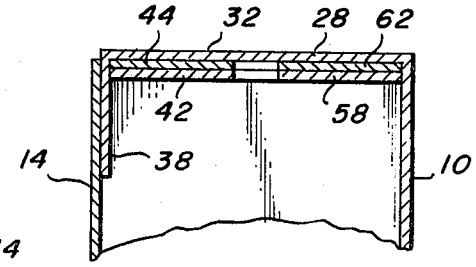
FIG. 10 is a side sectional view of the top of the dispenser in its closed shipping condition.

When the dispenser is to be used for display for dispensing, the customer merely unfolds the top of the dispenser from its closed shipping condition of FIG. 10 to the open condition of FIG. 7. Subsequently, the second portions 58, 62 of the first and second side wall top members 48, 50 are folded downwardly in overlapping relation about the tenth fold lines 54, respectively as shown in FIG. 11. Owing to the angular arrangement of the tenth fold lines, the second portions of the first and second side wall top members are arranged in planes which are angularly arranged relative to the horizontal, respectively. The rear wall top flap 28 is then folded downwardly about the fifth fold line 30 to a position in contiguous relation with the first and second side wall top member portions. The rear wall top locking member 32 is then folded downwardly about the pair of spaced sixth fold lines 36 to a position parallel to the rear wall top flap. The rear wall top bridge flap 34 defines the space between the rear wall top flap and the rear wall top locking member. In this fashion, the first and second side wall top member second portions are encompassed by the rear wall top flap and the rear wall top locking member as shown in FIGS. 12 and 13. The rear wall top locking member is then locked into place, whereby the dispenser is in its open dispensing condition.

One arrangement for locking the rear wall top locking member in the open position is shown in FIGS. 1 and 13. The rear wall top locking flap 38 contains a locking tab 78 in the upper edge thereof and the rear wall 10 contains a through slit 80 adjacent the upper edge thereof. A second through slit 82 may also be provided in the fifth fold line 30. Accordingly, when the rear wall top locking member 32 is folded about the sixth fold lines 36 to a position parallel to the rear wall top flap 28, the locking tab 78 is adapted to be passed through one or both of the through slits 80, 82 as shown in FIG. 13 to lock the dispenser top in its open dispensing condition.

In order to provide increased access to the rolls within the dispenser, the dispenser blank may be torn along the zipper cut 72 to remove the first and second side wall top flaps 42, 44, and upper portions of the first side 12, front 14, and second side 16 walls as shown in FIG. 14.

While the open dispenser of FIG. 14 is illustrated as containing only a single roll 84 of sandpaper or the like, a number of rolls may be arranged therein depending upon the size of the dispenser and upon the size of the rolls.

The blank 102 shown in FIG. 15 illustrates an alternate embodiment of the dispenser. Like the blank in FIG. 1, the blank 102 of FIG. 15 contains first 104, second 106, and third 108 vertical fold lines defining rear 110, first side 112, front 114, and second side 116 walls. A horizontal fourth fold line 126 connects rear 118, first side 120, front 122, and second side 124 wall bottom flaps with their associated walls. A rectangular rear wall top flap 128 is connected with the rear wall by a horizontal fifth fold line 130. A rear wall top locking member 132 is connected with the rear wall top flap by a spaced pair of horizontal sixth fold lines 136 which define a rear wall top bridge flap 134 therebetween. A rear wall top locking flap 138 is connected with the rear wall top locking member by a horizontal seventh fold line 140.

First and second side wall top flaps 142, 150 are connected with their associated walls by a horizontal eighth fold line 146. First and second side wall top members 148, 150 are connected with their associated walls by a horizontal ninth fold line 152. The first and second side wall top members contain an angular tenth fold line 154 which defines first 56, 60 and second 58, 62 portions in the top members, respectively.

As in the blank of FIG. 1, a locking wall 168 is connected with the rear wall by a vertical eleventh fold line 170 and a zipper cut 172 is provided in the first side, front, and second side walls. Similarly, the first side wall bottom flap 120 contains a cut-out portion 174 and the second side wall bottom flap 124 contains a tab 176.

The blank 102 is folded in the same manner as the blank 2 of FIG. 1 to form a dispenser having both closed shipping and open dispensing conditions.

The blank 102 differs from the blank 2 of FIG. 1 by the locking device for locking the top of the dispenser in the open dispensing condition. Accordingly, the blank 102 contains a pair of locking tabs **178*a*, 178*b* connected with the rear wall top locking flap 138 by a pair of spaced vertical twelfth fold lines 190. Furthermore, the first portions 156, 160 of the first and second side wall top members 148, 150 each contain a through-slit 180, 182 parallel to and spaced from the tenth fold line 154. When the rear wall top locking member 132 is folded about the sixth fold lines to a position parallel to and spaced from the rear wall top flap 128, the locking tab 178*a* is inserted into the through-cut 182 in the second side wall top member first portion 160 and the locking tab 178*b* is inserted into the through-cut 180 in the first side wall top member first portion 156** to lock the top of the dispenser in the open dispensing condition.

A serration device 184 is provided for aiding in tearing a portion of the product from the roll if desired. The serration device is formed of any suitable metal and is wrapped around and connected with the rear wall top locking member of the blank as shown in FIGS. 15 and 17. The device includes a serrated edge 186 as shown in FIG. 16 which is arranged adjacent the rear wall top bridge flap 134 of the folded dispenser top as shown in FIG. 18. Thus, when a length of sandpaper is pulled from the roll within the dispenser, the length may be torn from the roll by pulling the length up and backwardly over the serrated edge adjacent the bridge flap.

9. A blank as defined in claim 2, and further comprising locking means for locking said blank in its tubular configuration.

10. A blank as defined in claim 9, wherein said locking means comprises a locking wall connected by a vertical eleventh fold line with the free edge of said rear wall, said locking wall being secured to the inner surface of said second side wall when the blank is folded into its tubular configuration.

* * * * *